US005698938A

United States Patent [19]

Kim et al.

[11] Patent Number: 5,698,938

[45] Date of Patent: Dec. 16, 1997

[54] FRAME STRUCTURE FOR A CATHODE-RAY TUBE

[75] Inventors: Sung Dae Kim, Songtan; Seog Gwan Kim; Jang Weon Seo, both of Kyunggi-Do; Bong Kyo Jeong, Taegu, all of Rep. of Korea

[73] Assignee: LG Electronics, Inc., Seoul, Rep. of Korea

[21] Appl. No.: 618,121

[22] Filed: Mar. 19, 1996

[30] Foreign Application Priority Data

Jul. 4, 1995 [KR] Rep. of Korea ..... P95-19535

[51] Int. Cl.[6] ..... H01J 29/80

[52] U.S. Cl. ..... 313/407; 313/402; 313/404

[58] Field of Search ..... 313/402, 404, 313/407

[56] References Cited

U.S. PATENT DOCUMENTS

| | | | |
|---|---|---|---|
| 4,362,963 | 12/1982 | Puhak | 313/407 |
| 4,461,971 | 7/1984 | Puhak | 313/407 |
| 5,072,150 | 12/1991 | Lee | 313/407 X |

*Primary Examiner*—Sandra L. O'Shea
*Assistant Examiner*—Mach Haynes
*Attorney, Agent, or Firm*—Oppenheimer Poms Smith

[57] ABSTRACT

A frame structure which can reduce the howling phenomena generated by the vibration of computer monitors or television sets. The frame structure is mounted within a cathode-ray tube and has a hollow rectangular shape within which a shadow mask can be inserted and fixed. Each corner of the frame is formed with a recessed step to increase the stiffness of the frame.

6 Claims, 3 Drawing Sheets

BEFORE REINFORCING THE STIFFNESS

AFTER REINFORCING THE STIFFNESS

FRAME STRUCTURE FOR A CATHODE-RAY TUBE

BACKGROUND OF THE INVENTION

1. Field of the Invention

The present invention relates to a frame structure for a cathode-ray tube, in particular to a frame structure for a cathode-ray tube which can reduce howling phenomena generated from the vibrations of a computer monitor or television set.

2. Description of the Prior Art

Generally, a computer system is divided into a monitor and a main body. FIG. 1 is a front view schematically showing a construction of a usual computer system. Referring to FIG. 1, the computer system includes a monitor 1, and speakers 2 respectively mounted on left and right sides of the monitor 1. A frame structure incorporated within the monitor 1, as shown in FIG. 2, comprises a frame fixed to the panel 3 of the monitor at a number of locations by a number of springs 4, and a shadow mask 6 inserted into and fixed to the frame 5.

In the computer system with the above mentioned construction, the speakers 2 are directly attached to the monitor 1 and thus sound waves emitted from the speakers 2 are transferred to the case of the monitor 1, sequentially passes through the panel 3, springs 4 and frame 5, and arrives at the shadow mask 6, thereby producing the howling phenomena.

Namely, the howling phenomena is produced by the transfer of vibration from the frame directly connected to the shadow mask. Therefore, it is necessary to suppress the vibrations by increasing the stiffness of the frame in order to reduce the howling phenomena.

FIG. 3A and 3B are graphs showing vibration transfer rates of a frame before and after reinforcing the stiffness of the frame, respectively.

As shown in FIGS. 3A and 3B, the vibration transfer rates can be suppressed if the stiffness of the frame is increased.

FIG. 4 is a perspective view illustrating a usual frame for a cathode-ray tube. With reference to FIG. 4, the frame has a hollow rectangular shape each of upper, lower, left, and right sides of the frame being provided with a slot at the central portion thereof.

The usual form for a cathode-ray tube as explained above generally does not have sufficient stiffness since it does not have any stiffness reinforcement at its corner portions. As a result, the frame itself oscillates since the vibrations transferred through springs are not effectively suppressed, and the vibrations of the frame are transferred to the shadow mask, thereby generating substantial howling phenomena on the screen of the monitor or a television set.

FIG. 5 is a graph showing howling grades produced by a usual frame for a cathode-ray tube. With reference to FIG. 5, the howling grade 1.5 to 2 indicates slight howling generated in a portion of the screen, the howling grade 3 indicates slight howling generated all over the screen, and the howling grade higher than 3.5 indicates severe howling generating light and darkness vibrations all over the screen. As can be seen from FIG. 3, the usual frame for the cathode-ray tube generates howling phenomena having a grade higher than 3.

SUMMARY OF THE INVENTION

The object of the present invention is to solve the problems as explained above and to provide a frame structure for a cathode-ray tube which can reduce howling phenomena by modifying the construction of the frame corners to increase the stiffness of the frame.

In order to achieve the above object, the present invention provides a frame structure mounted within a cathode-ray tube and having a hollow rectangular shape within which a shadow mask can be inserted and fixed, characterized in that each corner of the frame is formed with a recessed step having a predetermined dimension.

BRIEF DESCRIPTION OF THE DRAWINGS

The above and other objects, features, and advantages of the present invention will become more apparent through the following description of the preferred embodiments of the present invention made with reference to the attached drawings in which.

DETAILED DESCRIPTION OF THE PREFERRED EMBODIMENT

Hereinafter, a preferred embodiment of a frame structure for a cathode-ray tube according to the present invention will be explained in detail with reference to FIGS. 6 to 8.

Figure 1:
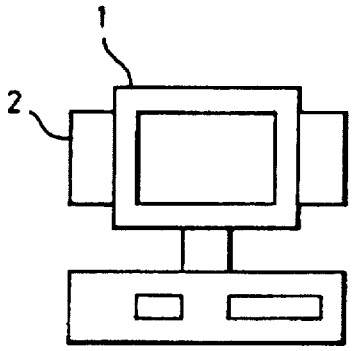
FIG. 1 is a front view schematically illustrating a construction of a typical computer system.
Figure 2:
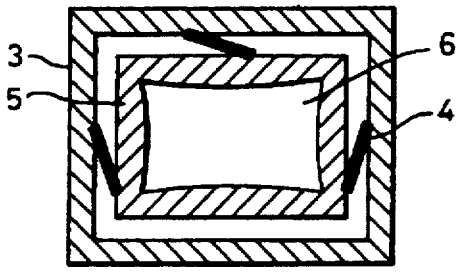
FIG. 2 is a vertical cross-section view schematically illustrating the frame structure mounted inside of a cathode-ray tube.
Figure 3A:
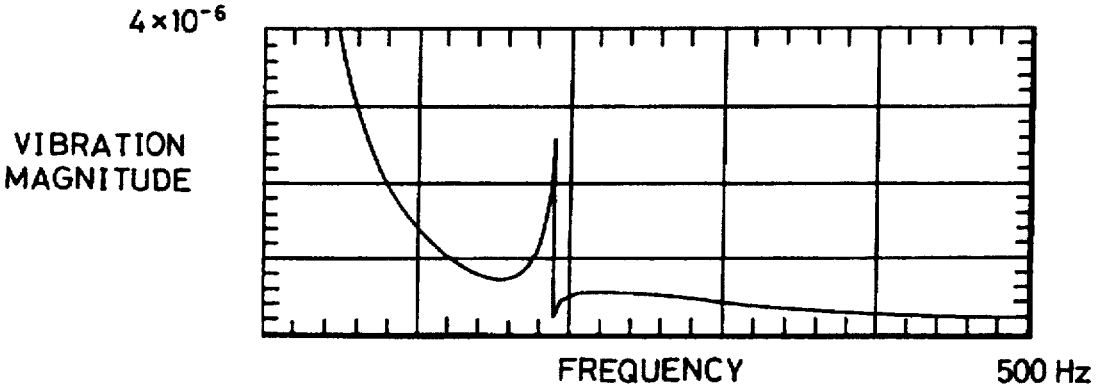
FIGS. 3A and 3B are graphs showing vibration transfer rates of a frame structure before and after reinforcing the stiffness of the frame, respectively.
Figure 3B:
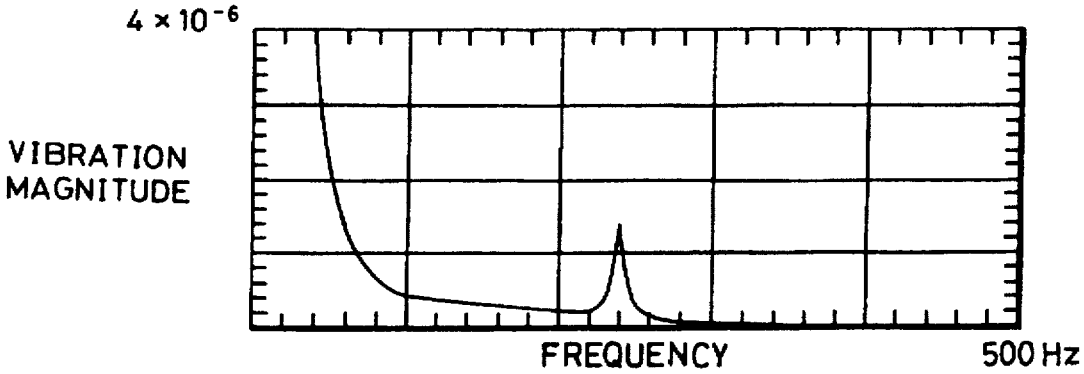
Figure 4:
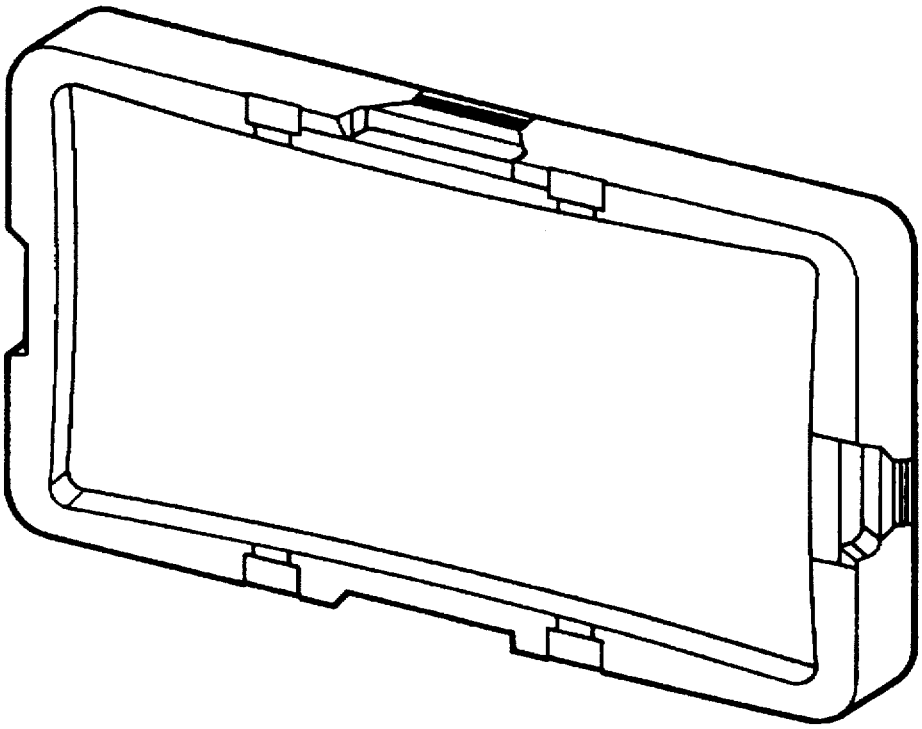
FIG. 4 (PRIOR ART)
FIG. 4 is a perspective view of a typical frame structure for a cathode-ray tube.
Figure 5:
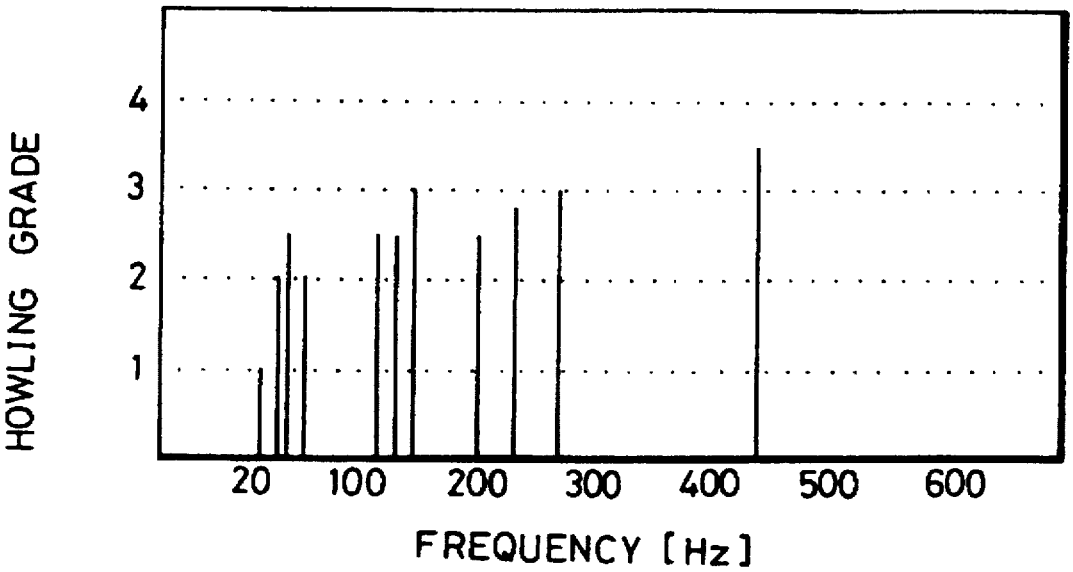
FIG. 5 (PRIOR ART)
FIG. 5 is a graph showing howling grades produced by the typical frame for the cathode-ray tube.
Figure 6:
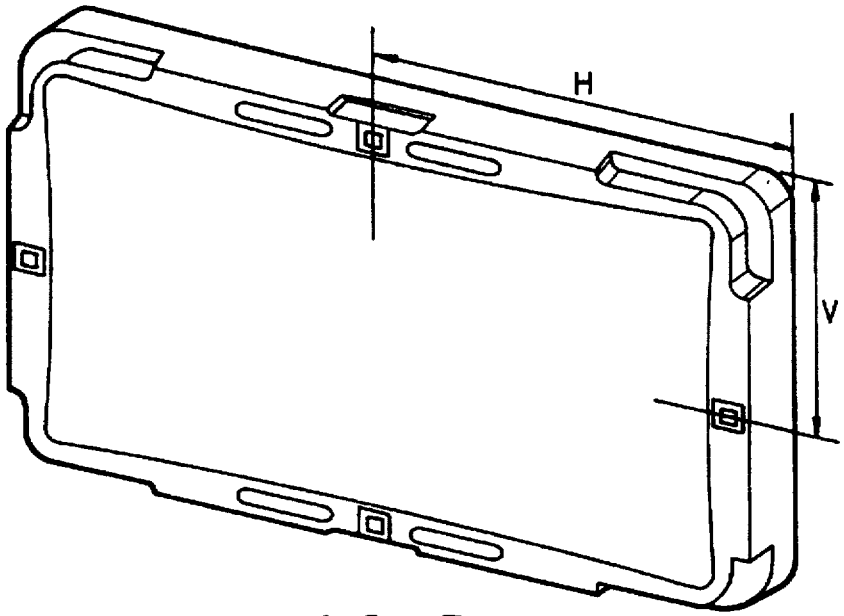
FIG. 6 is a perspective view of a frame structure in accordance with the present invention.
Figure 7:
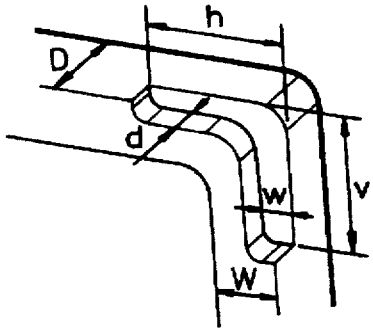
FIG. 7 is a perspective view showing a corner portion of the frame structure shown in FIG. 6 in an enlarged scale.

Referring to FIGS. 6 and 7, the frame structure for the cathode-ray tube includes recessed steps formed on four corners of the hollow rectangular shape frame structure by cutting each corner of the frame to a predetermined dimension in horizontal and vertical lengths and depths. As illustrated in FIG. 6, the recessed steps reduce the total cross sectional area of the frame, where the cross sectional area is taken along a plane which passes through each of the four sides of the frame and the recessed step. As can be seen from the figure, when the cross sectional area is thus taken, the cross sectional area defines a generally rectangular shape having four sides and four corners.

As explained above, the vibration phenomena of a shadow mask can be reduced, if the stiffness of a frame supporting the shadow mask is increased. Here, the increase of the frame stiffness means that the inherent or resonant frequencies become increased.

Referring to FIG. 7, the specific dimensions of the frame structure of the present invention are determined in the following manner. At first, halves of the entire horizontal and vertical lengths are set as parameters H and V, respectively, and the entire horizontal and vertical depths of each frame corner portion are set as parameters W and D. Regarding the dimensions of respective portions of recessed steps, the horizontal and vertical lengths of each recessed step are set as parameters h and v, respectively and the horizontal and vertical depths of each recessed step are set as parameters w and d, respectively. The inventors examined the inherent or resonant frequencies of the frame structure while changing the parameters h, v, w, and d set in the above manner.

TABLE 1

The Variations Of Inherent or Resonant Frequencies Related To The change Of Horizontal Lengths (h/H)

| h/H | 1st | 2nd | 3rd | 4th | 5th | 6th | 7th |
|---|---|---|---|---|---|---|---|
| 1/6 | 52.3 | 225 | 291 | 334 | 461 | 501 | 515 |
| 2/6 | 56.2 | 235 | 353 | 405 | 492 | 517 | 561 |
| 3/6 | 57.4 | 223 | 332 | 413 | 492 | 511 | 556 |
| 4/6 | 58.2 | 220 | 325 | 421 | 491 | 510 | 559 |
| 5/6 | 53.0 | 219 | 306 | 394 | 490 | 509 | 533 |

TABLE 2

The Variations Of Inherent or Resonant Frequencies Related To The change Of Vertical Lengths (v/V)

| v/V | 1st | 2nd | 3rd | 4th | 5th | 6th | 7th |
|---|---|---|---|---|---|---|---|
| 1/6 | 54.6 | 229 | 319 | 382 | 470 | 494 | 537 |
| 2/6 | 58.0 | 237 | 339 | 401 | 514 | 566 | 575 |
| 3/6 | 60.0 | 244 | 343 | 405 | 509 | 652 | 663 |
| 4/6 | 59.8 | 236 | 343 | 404 | 507 | 652 | 661 |
| 5/6 | 58.0 | 230 | 337 | 409 | 478 | 632 | 675 |

TABLE 3

The Variations Of Inherent Frequencies Related To The change Of Horizontal Depths (w/W)

| w/W | 1st | 2nd | 3rd | 4th | 5th | 6th | 7th |
|---|---|---|---|---|---|---|---|
| 1/6 | 49.8 | 282 | 306 | 320 | 430 | 455 | 580 |
| 2/6 | 53.3 | 270 | 304 | 352 | 475 | 500 | 575 |
| 3/6 | 56.8 | 245 | 324 | 384 | 511 | 540 | 564 |
| 4/6 | 58.0 | 235 | 338 | 402 | 509 | 565 | 568 |
| 5/6 | 57.8 | 244 | 350 | 413 | 495 | 573 | 586 |
| 6/6 | 55.0 | 241 | 358 | 414 | 480 | 567 | 579 |

TABLE 4

The Variations Of Inherent or Resonant Frequencies Related To The Change Of Vertical Depths (d/D)

| d/D | 1st | 2nd | 3rd | 4th | 5th | 6th | 7th |
|---|---|---|---|---|---|---|---|
| 1/6 | 50.3 | 284 | 308 | 343 | 442 | 466 | 561 |
| 2/6 | 55.6 | 259 | 331 | 372 | 463 | 488 | 559 |
| 3/6 | 54.5 | 241 | 332 | 413 | 492 | 511 | 556 |
| 4/6 | 58.5 | 220 | 325 | 421 | 491 | 510 | 559 |
| 5/6 | 59.0 | 219 | 306 | 394 | 490 | 509 | 533 |

Considering the variations of inherent or resonant frequencies as indicated in the above tables, the range of each parameter which can effectively increase frame stiffness were determined and it was found that the optimal results can be obtained if the horizontal length h is about 2/6 to 4/6 H, the vertical length v is about 2/6 to 4/6 V, the horizontal depth w is about 3/6 to 5/6 W, and the vertical depth d is about 2/6 to 5/6 D.

The variation characteristics of the inherent or resonant frequencies as explained above were examined using 15" color cathode-ray tubes. However, since the characteristics of the frames are typically changed linearly, the optimal dimensional ratios set in accordance with the present invention as indicated above can be applied to all kinds of the frames for cathode-ray tubes regardless of the screen size of the cathode-ray tubes and whether the cathode-ray tubes is used for monitors or color television sets.

Figure 8:
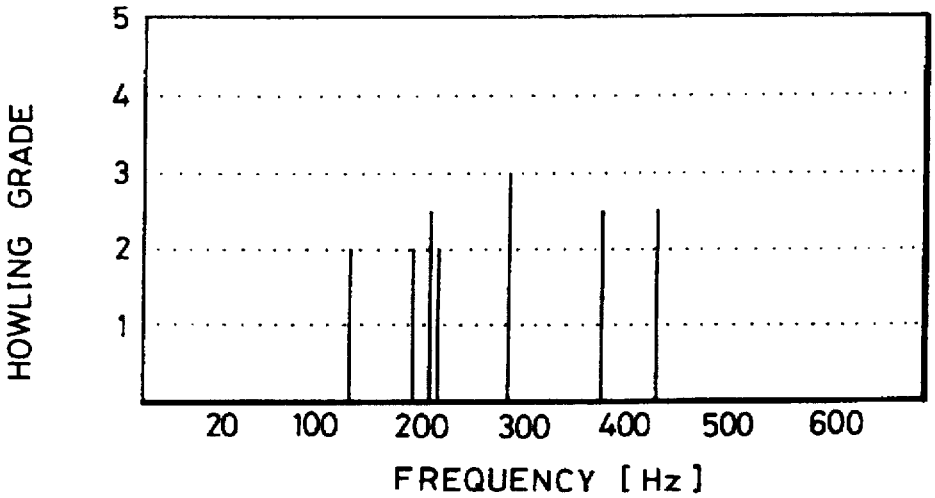
FIG. 8 is a graph showing the howling grades of the frame structure in accordance with the present invention.

FIG. 8 is a graph showing the howling phenomena produced by the frame structure according to the present invention.

As can be seen from FIG. 8, the frame for the cathode-ray tube formed with recessed steps to have the above optimal dimensional ratios at the corner portions thereof in accordance with the present invention has increased inherent or resonant frequencies and hence reduced vibration magnitudes, whereby the howling phenomena of the frame can be significantly reduced. Furthermore, the frame structure in accordance with the present invention is hardly deformed when static loads are applied thereto, and is highly durable to vibrations and impacts generated within itself since the vibration magnitudes are reduced.

What is claimed is:

1. A frame structure mounted within a cathode-ray tube and having a hollow rectangular shape within which a shadow mask can be inserted and fixed, characterized in that each corner of the frame is formed with a recessed step having a predetermined dimension, and that the frame has a generally rectangular cross sectional configuration; and each recessed step constitutes a cut-out formed in one corner of the cross sectional configuration of the frame, reducing the total cross sectional area of the frame in the corners of the frame and leaving a greater cross sectional area in the intermediate portions of the frame, interconnecting the corners of the frames with the recessed steps; and said recessed steps extending along the sides of said frame for short distances from said corners of said frame; said cross-sectional area being taken along a plane passing through each side of said frame and said recessed steps, said cross sectional area defining a generally rectangular shape having four sides and four corners.

2. A frame structure mounted within a cathode-ray tube and having a hollow rectangular shape within which a shadow mask can be inserted and fixed, characterized in that each corner of the frame is formed with a recessed step having a predetermined dimension; and the horizontal length h of the recessed step is about 2/6 to 4/6 H, the vertical length v thereof is 2/6 to 4/6 V, the horizontal depth w is 3/6 to 5/6 W, and the vertical depth d is 2/6 to 5/6 D, wherein H and D are halves of the entire horizontal and vertical length of the frame, respectively, and W and D are the entire horizontal and vertical depths of the corner portions of the frame, respectively.

3. A rectangular frame for securing a shadow mask while minimizing vibrations, said frame comprising:

an upper and a lower side members, each having a predetermined width, W, a predetermined depth, D, and a predetermined horizontal length, H;

a right and a left side members, each having a predetermined width, W, a predetermined depth, D, and a predetermined vertical length V;

said upper, lower, right, and left side members meeting at right-angled corners to form the rectangular frame;

said side members having recessed steps of predetermined size at each of said corners for increasing the stiffness and the inherent frequency of the frame;

each of said recessed steps having a horizontal length of 1/6th to 2/6th of H, a vertical length of 1/6th to 2/6th of V; a depth of 2/6th to 5/6th of D, and a width of 3/6th to 5/6th of W.

4. The rectangular frame as defined in claim 3 wherein said frame is mounted within a cathode-ray tube (CRT) for supporting a shadow mask within the cathode-ray tube.

5. A stiff rectangular frame resistant to vibrations comprising:

four side members meeting at right-angled corners to form the rectangular frame, said side members having predetermined lengths, depths, and widths;

said side members further comprising recessed steps, proximal to said corners, to increase the stiffness and inherent resonant frequency of said frame;

said recessed steps having lengths, depths, and widths which are in a predetermined ratio to said lengths, depths, and widths of said side members; and said side members each having a central portion having a predetermined cross-sectional area, and each of said recessed steps being recessed into said side members at the corners thereof and said frame having a substantially reduced cross-sectional area near the corners of said frame at the locations of said recessed steps, said cross sectional area being taken along a plane passing through each of the four side members and said recessed steps, said cross sectional area defining a generally rectangular shape having four sides and four corners;

said recessed steps extending for short distances along the sides of said frame from the corners of said frame.

6. A stiff rectangular frame resistant to vibrations comprising:

four side members meeting at right-angled corners to form the rectangular frame, said side members having predetermined lengths, depths, and a widths; and said side members further comprising recessed steps, proximal to said corners, to increase the stiffness and inherent resonant frequency of said frame;

said recessed steps having lengths, depths, and widths which are in a predetermined ratio to said lengths, depths, and widths of said side members; and said four side members further comprising upper and lower side members, each having a predetermined width, W, a predetermined depth, D, and a predetermined horizontal length, H; and right and left side members, each having a predetermined width, W, a predetermined depth, D, and a predetermined vertical length V; wherein said lengths, depths, and widths of said recessed steps are related to said lengths, depths, and widths of said side members, having a horizontal length of 1/6th to 2/6th of H, a vertical length of 1/6th to 2/6th of V; a depth of 2/6th to 5/6th of D, and a width of 3/6th to 5/6th of W.

* * * * *

US005698938B1

REEXAMINATION CERTIFICATE (4064th)

United States Patent [19] [11] B1 5,698,938

Kim et al. [45] Certificate Issued Apr. 25, 2000

[54] FRAME STRUCTURE FOR A CATHODE-RAY TUBE

[75] Inventors: Sung Dae Kim, Songtan; Seog Gwan Kim; Jang Weon Seo, both of Kyunggi-Do; Bong Kyo Jeong, Taegu, all of Rep. of Korea

[73] Assignee: Le Electronics Inc, Seoul, DPR of Korea

Reexamination Request:
No. 90/005,056, Jul. 27, 1998

Reexamination Certificate for:

| | |
|---|---|
| Patent No.: | **5,698,938** |
| Issued: | **Dec. 16, 1997** |
| Appl. No.: | **08/618,121** |
| Filed: | **Mar. 19, 1996** |

[30] Foreign Application Priority Data

Jul. 4, 1995 [KR] Rep. of Korea ..... P95-19535

[51] Int. Cl.[7] ..... H01J 29/80

[52] U.S. Cl. ..... 313/407; 313/402; 313/404

[58] Field of Search ..... 313/402, 404, 313/407, 461, 477 R

[56] References Cited

FOREIGN PATENT DOCUMENTS

| | | |
|---|---|---|
| 56-31456 | 8/1954 | Japan . |
| 63-34205 | 9/1988 | Japan . |

*Primary Examiner*—Nimeshkumar D. Patel

[57] ABSTRACT

A frame structure which can reduce the howling phenomena generated by the vibration of computer monitors or television sets. The frame structure is mounted within a cathode-ray tube and has a hollow rectangular shape within which a shadow mask can be inserted and fixed. Each corner of the frame is formed with a recessed step to increase the stiffness of the frame.

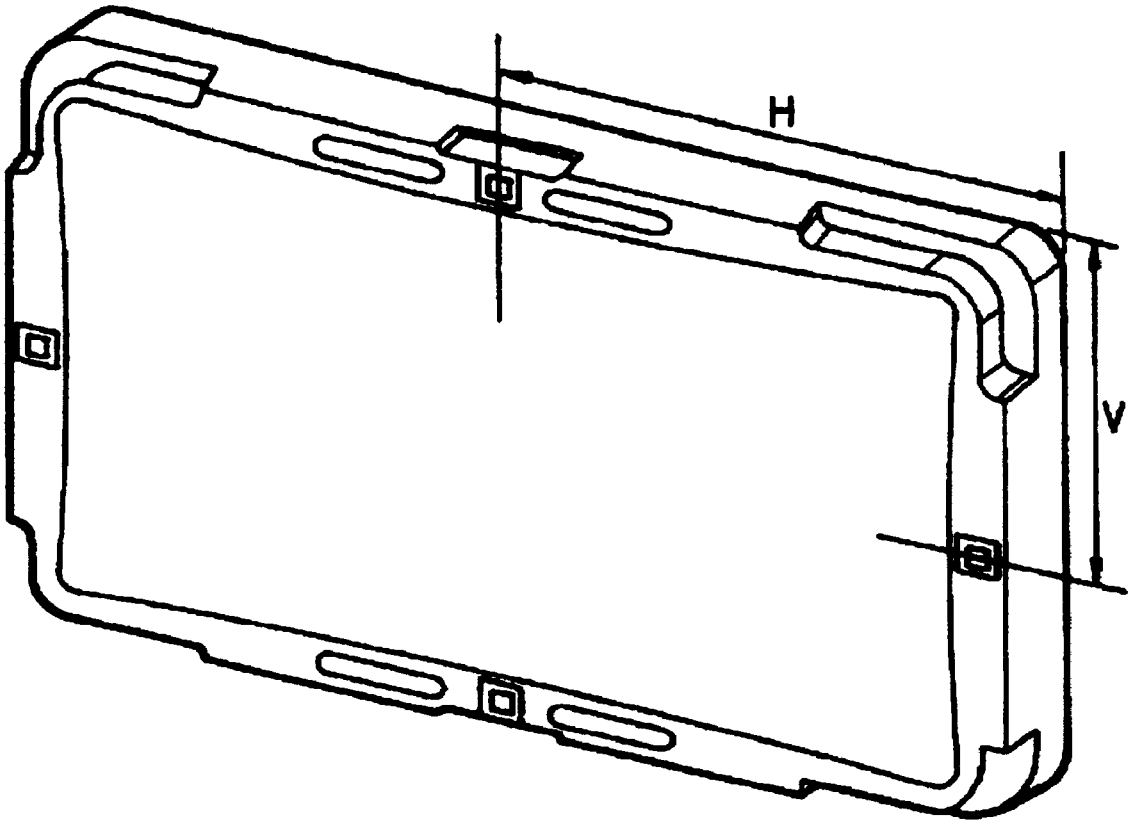

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3–4 and 6 is confirmed.

Claims 1, 2 and 5 are determined to be patentable as amended.

1. A frame structure mounted within a cathode-ray tube and having a hollow rectangular shape within which a shadow mask can be inserted and fixed, characterized in that each corner of [the] *said* frame is formed with a recessed step having a predetermined dimension, and that [the] *said* frame has a generally rectangular cross sectional configuration; and each *said* recessed step constitutes a cut-out formed in one corner of [the] *said* cross sectional configuration of [the] *said* frame, reducing the total cross sectional area of [the] *said* frame in corners of *said* frame and leaving a greater cross sectional area in the intermediate portions of [the] *said* frame, interconnecting the corners of [the frames] *said frame* with [the] *said* recessed steps; [and said recessed steps extending along the sides of said frame for short distances from said corners of said frame;] said cross-sectional area being taken along a plane passing through each side of said frame and said recessed steps, said cross sectional area defining a generally rectangular shape having four sides and four corners*, wherein the horizontal length of said recessed step is at least 1/6 H, the vertical length thereof is at least 1/6 V, the horizontal depth of said recessed step is at least 1/6 W, and the vertical depth thereof is at least 1/6 D, wherein H and V are halves of the horizontal and vertical lengths of the frame, respectively, and W and D are the horizontal and vertical depths of said corners of the frame, respectively.*

2. A frame structure mounted within a cathode-ray tube and having a hollow rectangular shape within which a shadow mask can be inserted and fixed, characterized in that each corner of the frame is formed with a recessed step having a predetermined dimension; and the horizontal length h of the recessed step is about 2/6 to 4/6 H, the vertical length v thereof is 2/6 to 4/6 V, the horizontal depth w is 3/6 to 5/6 W, and the vertical depth d is 2/6 to 5/6 D, wherein H and [D] *V* are halves of the entire horizontal and vertical length of the frame, respectively, and W and D are the entire horizontal and vertical depths of the corner portions of the frame, respectively.

5. A stiff rectangular frame resistant to vibrations comprising:

four side members meeting at right-angled corners to form the rectangular frame, said side members having predetermined lengths, depths, and widths;

said side members further comprising recessed steps, proximal to said corners, to increase the stiffness and inherent resonant frequency of said frame;

said recessed steps having lengths, depths, and widths which are in a predetermined ratio to said lengths, depths, and widths of said side members; and said side members each having a central portion having a predetermined cross-sectional area, and each of said recessed steps being recessed into said side members at the corners thereof and said frame having a substantially reduced cross-sectional area near the corners of said frame at the locations of said recessed steps, said cross-sectional area being taken along a plane passing through each of the four side members and said recessed steps, said cross-sectional area defining a generally rectangular shape having four sides and four corners;

[said recessed steps extending for short distances along the sides of said frame from the corners of said frame], *wherein the horizontal length of said recessed step is at least 1/6 H, the vertical length thereof is at least 1/6 V, the horizontal depth of said recessed step is at least 1/6 W, and the vertical depth thereof is at least 1/6 D, wherein H and V are halves of the horizontal and vertical lengths of the frame, respectively, and W and D are the ehorizontal and vertical depths of said corners of the frame, respectively.*

* * * * *